US005692754A

United States Patent [19]

Rostami

[11] Patent Number: 5,692,754

[45] Date of Patent: Dec. 2, 1997

[54] ADVANCED CHESS GAME AND METHOD THEREFOR

[75] Inventor: Ali R. Rostami, Salt Lake City, Utah

[73] Assignee: Sure Realestate Investment Corporation, Salt Lake City, Utah

[21] Appl. No.: 730,400

[22] Filed: Oct. 15, 1996

[51] Int. Cl.[6] ..... A63F 3/02

[52] U.S. Cl. ..... 273/261

[58] Field of Search ..... 273/236, 242, 273/260, 261; 463/14

[56] References Cited

U.S. PATENT DOCUMENTS

| | | | |
|---|---|---|---|
| 3,724,856 | 4/1973 | Welch | 273/261 |
| 4,033,586 | 7/1977 | Corinthios | 273/260 |
| 4,052,069 | 10/1977 | Sandhu | 273/261 |
| 4,552,364 | 11/1985 | Shaffer | 273/260 |
| 5,511,793 | 4/1996 | Watt | 273/261 X |
| 5,582,410 | 12/1996 | Hunt | 273/261 |

FOREIGN PATENT DOCUMENTS

| | | | |
|---|---|---|---|
| 2617053 | 12/1988 | France | 273/260 |
| 386445 | 12/1923 | Germany | 273/260 |
| 1703150 | 1/1992 | U.S.S.R. | 273/260 |

*Primary Examiner*—William E. Stoll
*Attorney, Agent, or Firm*—A. Ray Osburn

[57] ABSTRACT

An advanced chess game which has a game board having an upper surface for playing the advanced chess game and two sets of game pieces for use by a player and an opposing player. The rectangular playing surface provides additional playing squares over the standard chess game. Each set of game pieces includes the standard set of chess pieces from the standard chess game except that only five, instead of eight, Pawns are used. The sets each include game pieces of two new and different designs, one called a Checker and the other a Cavalry. While each of the standard chess pieces used operate in accordance with the rules of standard chess, the new Checker piece moves an unlimited number of spaces at a time in one of a forward, backward, left and right direction. The new and different Cavalry piece is similar to the standard Pawn in movement, but may additionally capture straight forward one square. The game provides many easily learned potential game scenarios because of the increased number of squares and the characteristic moving and capturing capabilities of the two new pieces.

14 Claims, 4 Drawing Sheets

ADVANCED CHESS GAME AND METHOD THEREFOR

BACKGROUND OF THE INVENTION

1. Field

The invention relates to board games and more particularly to an advanced chess game and method which provides a new playing surface with more squares than used in standard chess, selected standard game pieces from said standard game, and two new game pieces, each having a new and distinctive appearance.

2. State of the Art

The standard game of chess is well known and is believed by many accomplished players to be excessively known, its possibilities too well understood and predictable. The lengthy history of the game dates from the invention of the basic playing board, pieces and playing rules around the fifth century in India. It has been played an extremely large number of times. Many game situations and scenarios have been conceived, played over and over again and repeatedly published throughout the world. Chess instruction and strategy books are very numerous, analyzing and expounding upon quite well known attack and defense patterns. Chess instruction columns are regularly published in newspapers, and standard chess game magazines are periodically published. All this has followed geographic expansion into Italy, Spain and other European countries during the ninth or the tenth century. During this era, the game experienced one particularly significant evolution which made it more popular. The powers of the Queen were increased greatly, making it possible to play the game and win much more rapidly.

More recent attempts to improve the game by altering the basic playing board and playing pieces are exemplified by U.S. Pat. No. 5,421,582, which discloses a playing board with a significantly increased number of playing spaces, arranged together into an octagonal shape. The disclosed game is called an expanded chess game, and retains all of the standard chess pieces, and their moves and capturing modes. One or more of a new chess piece is added, which has moving and capturing capabilities different from any standard chess game piece. The number of playing squares is increased, and the shape of the playing surface is extensively altered, creating scenarios for the players which are quite drastically different from the those found in the standard chess game.

A need definitely exists for an advanced chess game to challenge a large number of expert aficionados of the game, who may have become somewhat jaded by exhaustion of the possibilities of standard chess, but who are discouraged by previously proposed overly difficult alternative games. Definite, but manageable change and expansion of the game possibilities are needed.

BRIEF SUMMARY OF THE INVENTION

With the foregoing in mind, the present invention eliminates or substantially alleviates the shortcomings in prior art chess-like games. A rectangular game board is provided having eight adjacent horizontal rows each having ten alternating light and dark playing squares, each of said squares in each horizontal row being also in a vertical row of eight alternating dark and light squares. The increase of the number of playing squares of the board without drastic changes in outline and appearance tends to permit many new games scenarios to be created, but does not overwhelm the typical player of standard chess, who finds the new game challenging but not overly formidable.

In addition to the changes in the game board, concomitant changes are made in the sets of playing pieces used in the standard game. The number of standard Pawns is reduced from eight to five for each player, and five new Pawn-like pieces called Cavalries are added. The Cavalries move similarly to the Pawns, but have somewhat increased power in that they may capture not only diagonally and in passing, but also straight ahead. The Cavalries and the Pawns, totaling ten pieces for each player, initially alternate across the board to occupy the second row of squares from the bottom and top edges of the new game board.

A pair of other new pieces called Checkers is provided each player, these new pieces being interposed in the first row of pieces at both edges of the board between a standard King and a King-side Bishop and between a Queen and a Queen-side Bishop. The Checker, unlike the Pawns and the Cavalries, is permitted to capture in either vertical direction and in either horizontal direction, generally entirely across the board in a single, selected direction from its starting square, but must come to rest on a square of the same color as that of its starting square. The Checker also has the power to jump intervening pieces, and in this respect is similar to the standard chess piece called the Knight. When jumping, the Checker must capture the first piece encountered occupying a square of proper color, ending the move. All standard chess pieces utilized in the game have the typical standard chess game powers for movement and capture.

The advanced chess game thus comprises a game board of eighty playing squares upon which are initially placed a set of twenty game pieces for a player and another set of twenty for an opposing player. The pieces for each player include all of the pieces for a standard chess game less three Pawns. The five Pawns remaining, as indicated above, alternate with five new Cavalry pieces in each of the two second rows from the upper and lower edges of the board. The remaining standard chess pieces are disposed along the two edge rows in the same order as in standard chess, except for separation of both the Queen and King from its associated Bishop by one of a pair of new Checkers. The lowermost edge row then initially has from left to right, a Rook, a Knight, a Bishop, a Checker, a King, a Queen, another Checker, another Bishop, another Knight and another Rook. The uppermost row of squares has the same pieces, placed in a mirror image of the lowermost row.

In the advanced game, all standard pieces are permitted the same moves and capturing modes as they are in the standard chess game. The movement and capturing power of the new Checker and Cavalry pieces are described above. The castling procedure of standard chess is retained in general, but in somewhat altered form, as subsequently described.

It is therefore the principal object of the invention to provide an advanced chess game and playing apparatus, and a method of playing the advanced game, which will provide the players with many additional interesting playing patterns.

BRIEF DESCRIPTION OF THE DRAWINGS

In the drawings, which represent the best modes presently contemplated for carrying out the invention.

DETAILED DESCRIPTION OF PREFERRED EMBODIMENT

Figure 1:
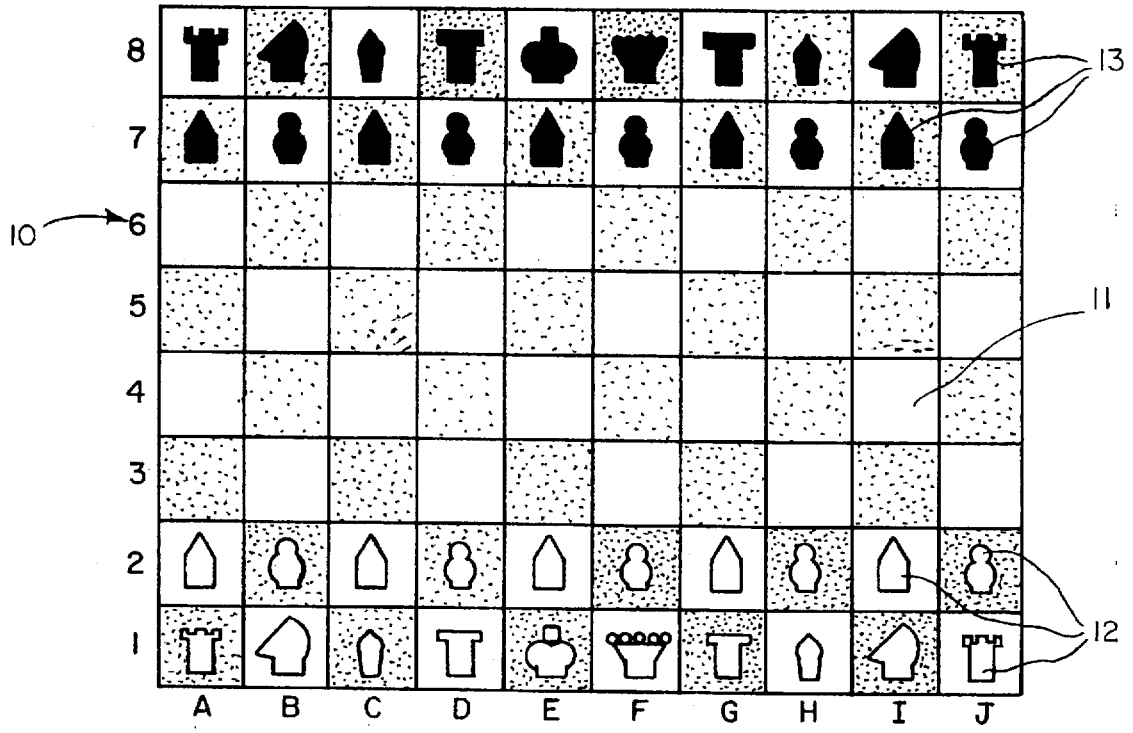
FIG. 1 is a plan view of the game board for the inventive advanced chess game, with sets of light and dark chess pieces, indicated in silhouette, placed thereon in the game starting positions, FIG. 2 a plan view of a game board for the standard game of chess, with sets of light and dark standard chess pieces indicated thereon in silhouette in the standard game starting positions.
Figure 2:
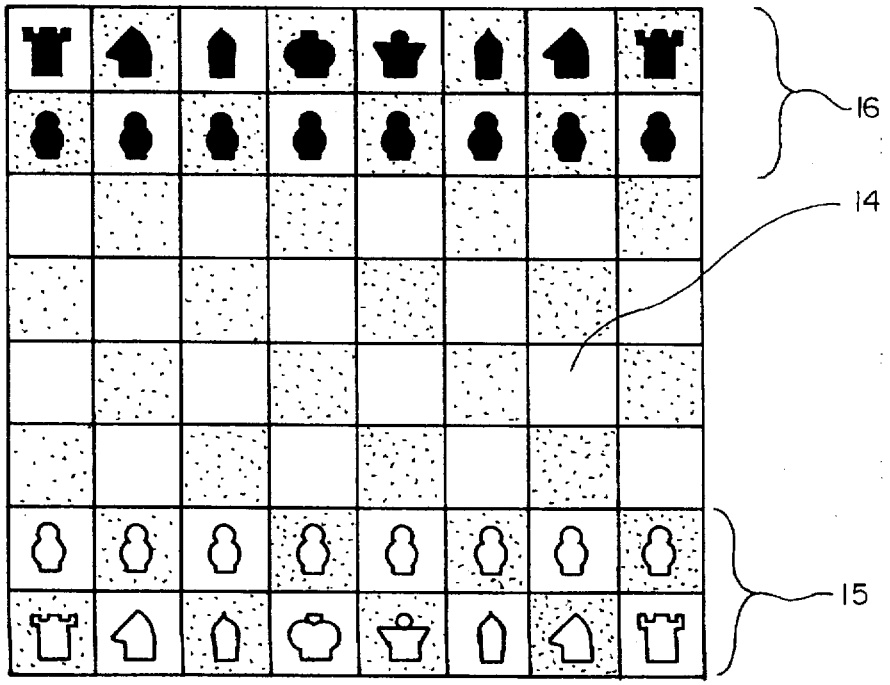

A game starting setup for the advanced chess game 10 comprises a playing surface 11 with horizontal rows 1–8of ten alternately light and dark playing squares A–J upon which are placed light and dark twenty piece sets 12 and 13 of playing pieces for a player and an opposing player respectfully. (FIG. 1) For comparison, in Prior Art FIG. 2 are seen the corresponding eight row, eight squares per row playing surface 14 and the sixteen piece sets 15 and 16 used in the familiar standard chess game. The playing surface 11 may be provided upon such materials as wood, cardboard, plastic, marble and the like. When the advanced game 10 is being played, foldable sections or the like, not illustrated, which may be used are connected to provide a flat playing surface. With appropriate software, the game may be played upon a computer, with the board and the pieces being displayed upon a screen.

The advanced chess playing surface 11 therefore comprises eight horizontal rows each of ten alternately dark and light squares, juxtaposed to form ten adjoining vertical rows of eight squares, each also alternately light and dark. All diagonally joining rows are each composed entirely of either light or dark squares. The horizontal rows are numbered sequentially 1 through 8 from bottom to top in FIG. 1, in which the vertical rows are designated from left to right alphabetically as A–J.

For starting the advanced chess game 10, one of the two players is provided with the twenty piece light colored set of pieces 12 and the other, the opposing player, with a twenty piece set 13 of dark pieces. Light and dark sets are disposed in rows 1 and 2 and 8 and 7 respectively.

Figure 3:
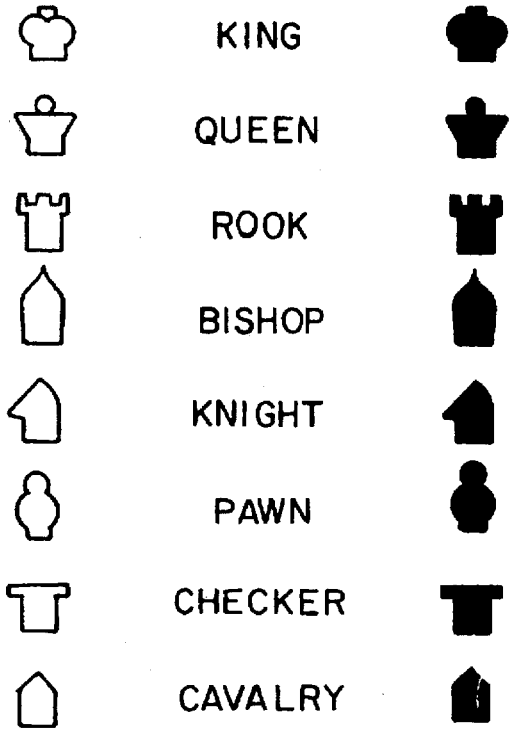
FIG. 3 shows the silhouette representation used for the light and dark sets of game pieces for the advanced chess game 10, along with the associated nomenclature for all pieces of the sets, FIG. 4 an upper front perspective representation of one of the new chess pieces called a Checker which is used in the advanced chess game, FIG. 5 an upper front perspective view of one of the new game pieces called a Cavalry which is used in the advance chess game, FIG. 5*a* a representation showing commonly used shapes of the pieces of standard chess, shown in elevation view, including a King, Queen, Rook, Bishop, Knight and Pawn, FIG. 6 a diagrammatic representation showing the permitted moves of the King in either standard or the advanced chess games, illustrated however upon an advanced chess game board, FIG. 7 a diagrammatic representation showing the permitted moves of a Queen playing piece in either the standard or the advanced chess games, illustrated however upon an advanced chess game board, FIG. 8 a diagrammatic representation of the permissible moves of the Rook playing pieces in both the standard and the advanced games, illustrated however upon an advanced chess game board, FIG. 9 a diagrammatic representation of the permissible moves of the Bishop playing pieces in both the standard and the advanced games, illustrated however upon an advanced chess game board, FIG. 10 a diagrammatic representation of the permissible moves of the Knight playing pieces in both the standard and the advanced chess games, illustrated however upon a fragment of a game board, FIG. 11 a diagrammatic representation of the permissible moves and capturing modes of the Pawn game piece in both the standard and the advanced chess games, FIG. 12 a diagrammatic representation of the permissible moves and capturing modes of the new Checker piece on an advanced chess game board, FIG. 13 a diagrammatic representation of the permissible moves and capturing modes of the new Cavalry chess piece in the advanced chess game, shown on a fragment of a game board, FIG. 14 a diagrammatic representation of the light and dark Kings and Rooks in positions on the advanced chess game board prior to a castling procedure to the right, Queen side, FIG. 15 a diagrammatic representation of the positions of the light and dark Kings and Rooks after castling to the right from the positions of the pieces shown in FIG. 14, FIG. 16 a diagrammatic representation of the light and dark Kings and Rooks in positions on the advanced chess game board prior to castling to the left, King side, and FIG. 17 a diagrammatic representation of the positions of the light and dark Kings and Rooks after castling to the left from positions of the pieces shown in FIG. 16.
Figure 4:
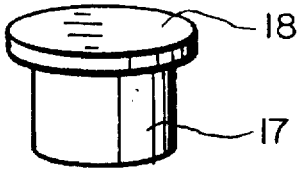
Figure 5:
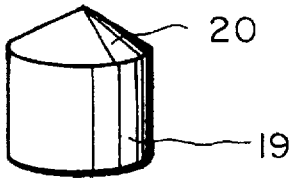
Figure 5A:
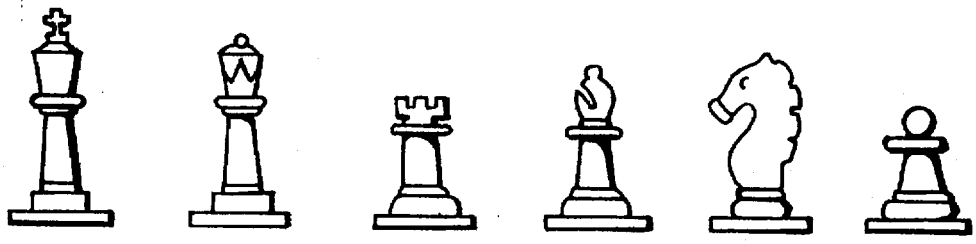
Figure 6:
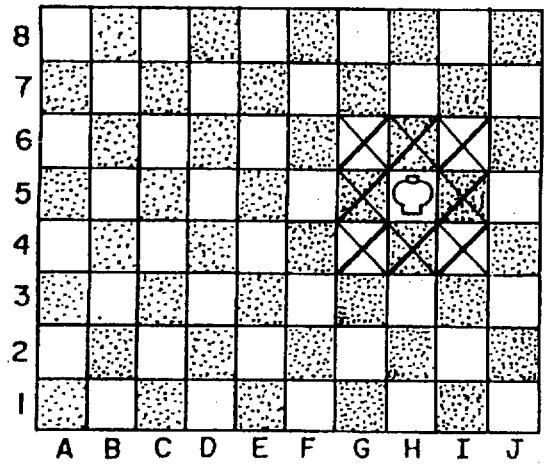
Figure 7:
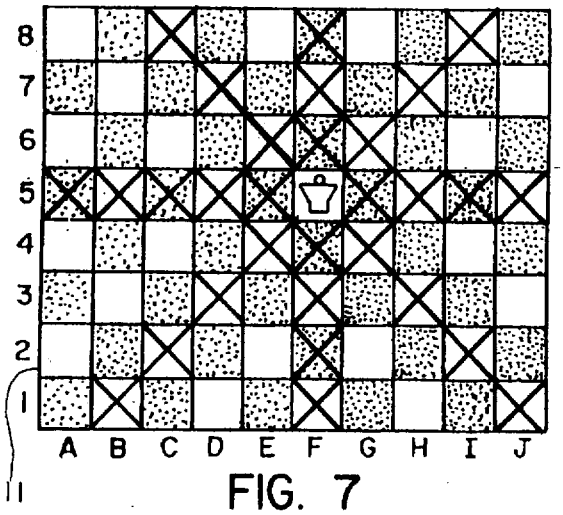

Except for the two new piece designs, called the Checker and the Cavalry, familiar pieces from the standard chess game are used, and are depicted in familiar silhouette shapes. (FIG. 3) The Checker may, to present a contrasting appearance, comprise a cylindrical base 17 with an overhanging circular cap 18, while the Cavalry may have a cylindrical body 16 capped with a cone 17. (FIGS. 4 and 5) However, many other distinguishing shapes not illustrated could be used for the two pieces.

The setup of pieces for starting the advanced game 10 is similar to that used in the standard chess game, (FIG. 2), except that for each player a Checker occupies each of the two spaces between the King and the King-side Bishop and the Queen and the Queen-side Bishop. In rows 2 and 7, five standard Pawn pieces alternate with five of the new Cavalry pieces. As with standard chess, each of the individual pieces of the opposing players, including the new Checkers and Cavalries, occupy facing positions in one of the vertical rows A–J. That is, the pieces of each of the sets 12 and 13 of the two players are placed upon the board to be in mirror image relationship to each other.

In accordance with the advanced game 10 starting setup of game pieces, row 1 has a Rook at both squares 1A and 1J, a Knight at both squares 1B and 1I, a Bishop at both squares 1C and 1H, a Checker at both squares 1D and 1G, a King at square 1E and a Queen at square IF. All the pieces in row 1 are shown as light colored. Opposing row 1 are the pieces in row 8, square 8A and 8J each being occupied by a dark Rook, squares 8B and 8I each by a dark Knight, 8C and 8H each by a dark Bishop, squares 8D and 8G each by a dark Checker, square 8E by a dark King and square 8F by a dark Queen. In row 2, each of the squares 2A, 2C, 2E, 2G, and 2I is occupied by one of the new Cavalry pieces, whereas square 2B, 2D, 2F, 2H and 2J are each occupied by a standard game piece Pawn. In line 7, squares 7A, 7C, 7E, 7G and 7I are each occupied by a dark new Cavalry piece, while squares 7B, 7F, 7H and 7J are each occupied by a standard dark Pawn piece. All of the squares in each of the rows 3, 4, 5 and 6 are unoccupied by any game pieces until the game has been started and is in progress.

As in the standard chess game, the object of both the player and the opposing player is to "capture" the King of the other. That is, the King of one of the players must, to end the game, be trapped in a position from which it is unable to move without moving into a capture position and in which it cannot be protected from capture. This situation is known as "checkmate".

All of the pieces of both players must move according to predetermined patterns in execution of the advanced chess game. For the standard pieces adopted from standard chess, the rules of movement are well known to experienced players, but are nevertheless described in the following paragraphs and illustrated in FIGS. 6–11, wherein the permitted squares of movement of the pieces are generally indicated by exes.

The King may be considered the most important piece in both the standard chess game and the advanced chess game 10, since the object of both games is its capture. However, the King can only move one square, in any direction but only providing that the destination square is unoccupied. (FIG. 6) The King may capture in any of the directions in which he may move by removing and taking the place of an opposing chess piece within the range of his movement. The King cannot displace or leap over his own pieces which may occupy a square within his range of movement.

While the king may be considered the most important piece in the games, the Queen is the most powerful, because she can move either vertically, horizontally or diagonally—one direction on any given move—to the extent that her movement is not obstructed by any other piece or pieces. (FIG. 7) However, the Queen cannot leap over or displace any of her own pieces and may capture only in the direction of her moves, by removing the captured chess piece and taking its place.

The Rook can move vertically or horizontally, to the extent that its movement is not obstructed by any other piece or pieces. (FIG. 8) It cannot leap over or displace any of its own pieces. The Rook captures only in the direction it moves, by removing the captured chess piece and taking its place in the same square upon the game board.

Figure 9:
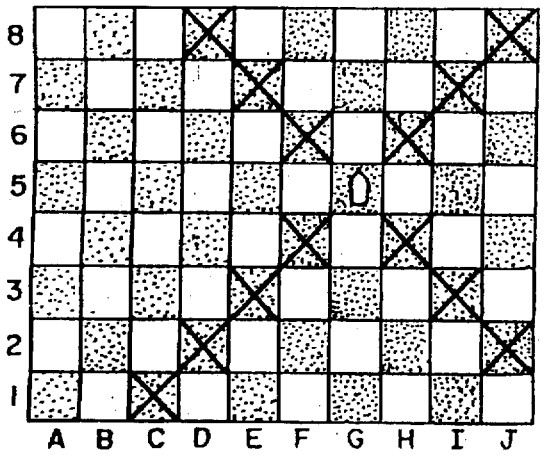
Figure 10:
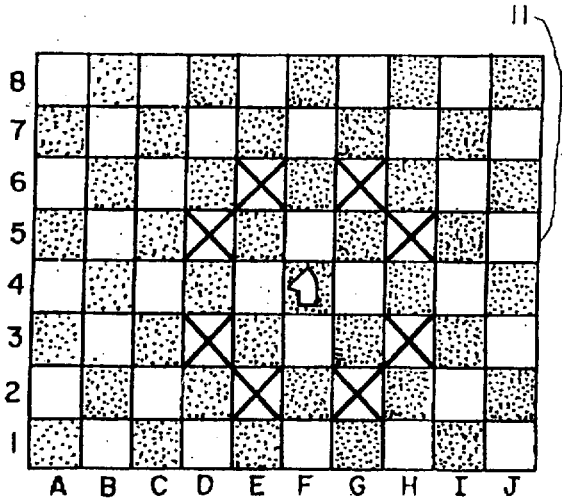

The Bishop in both games may move and capture diagonally an unlimited number of squares, but cannot jump over its own pieces nor capture them. (FIG. 9)

The Knight is the only standard game piece that can in the course of movement jump or leap over other pieces, either its own or those of the opposing player. Its move may start in any horizontal or vertical direction, and always totals three squares adjoining the square upon it initially rests. The squares of the movement are arranged in an "L"-shaped path. (FIG. 10) Two squares horizontally followed by one square vertically is one example, as is two squares vertically followed by one square horizontally. While the Knight can jump over pieces within its prescribed movement, it may capture only on the end square. In the course of an L-shaped movement, the Knight always lands on a square of different color from its starting square. That is, it may move from white to black or from black to white depending on its starting position.

Although the Pawn is the least powerful chess piece in terms of its capability to move and capture, it plays a very important role in both the standard and the advanced chess games. The Pawn's move is always in a forward direction, straight ahead. Once moved, the Pawn can never retreat in any direction, including the backward direction. Each Pawn moves only one square forward, except that the first time it moves from its initial starting square, at any time during the game, it has the option of moving forwardly either one square or two. Thereafter, that Pawn can move only one square at a time straight ahead for the rest of the game. Nor can the Pawn jump other pieces in its path when moving. See FIG. 11, wherein the two possible moves are indicated by arrows 21 and 22, and the capturing modes by dashed arrows 23 and 24. The Pawn does not capture in its direction of motion, but diagonally forward one square to the left or right regardless of whether the opposing Pawn at its option moves one or two squares. If the opposing Pawn has moved two squares, the capturing is called "en passant" or "in passing". In this situation, the capture must be made immediately before the would be capturing player moves any of his other pieces. Whether the opposing Pawn advances one or two squares, in an attempt to avoid capture, the capturing Pawn ends up on the same square—diagonally from its starting position in the vertical row which contained the captured Pawn. That is, the capture following a two square opposing Pawn movement is made exactly as if the opposing Pawn had moved only a single square.

Figure 12:
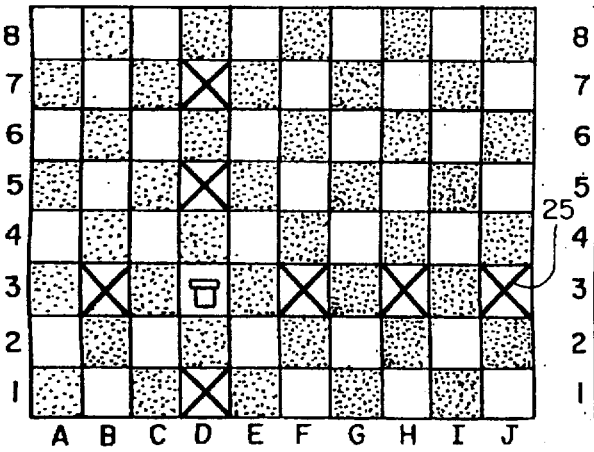
Figure 8:
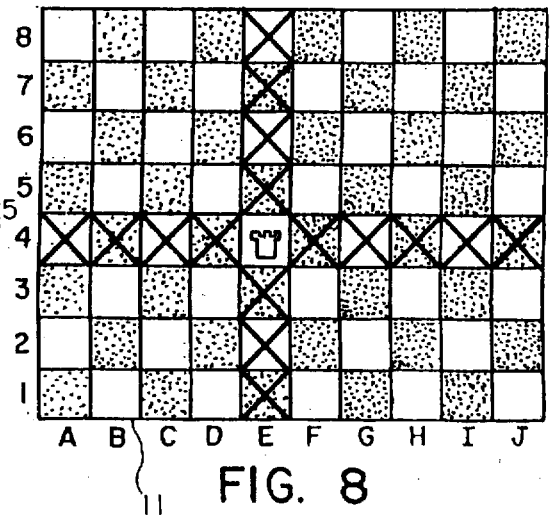
Figure 11:
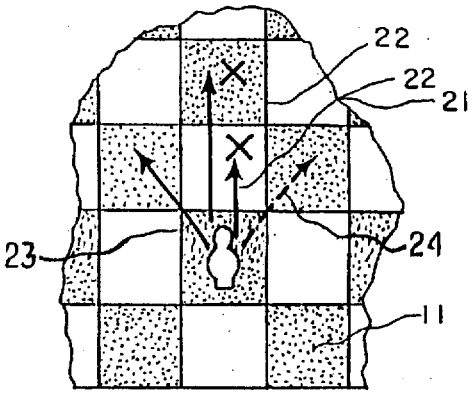

As previously noted, the advanced chess game 10 includes two new and differing pieces not found in the standard chess game. The first of these, the "Checker", can in general move an unlimited number of squares vertically in either direction, or horizontally in either direction. However, each move must end upon a square of the same color as that of the starting square, so that each move must be at least two squares long. Pieces of either color occupying squares of different color than that of the starting square may be jumped. Pieces of either color occupying squares of the color of the starting square cannot be jumped. The moving piece cannot go beyond a piece of its same color encountered on a square of the same color as that of the starting square. Also, the moving piece must capture an opposing piece found on a square of the same color as the starting square, replacing the opposing piece upon the board and ending the move. Accordingly, the Checker, initially in one of the edge rows 1 or 8, may leap over the piece occupying the adjacent square of row 2 or 7 respectively, to escape from its starting row immediately if so desired. See FIG. 12, wherein permissible destination squares are indicated by exes 25.

Figure 13:
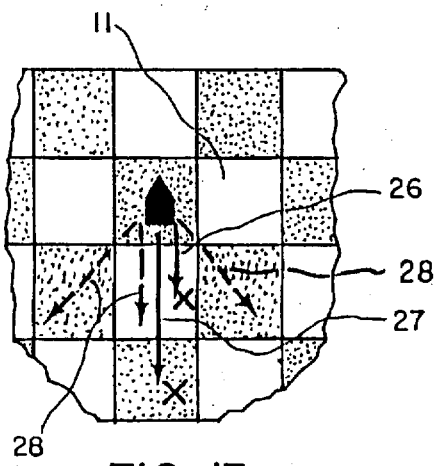

The second new piece, the "Cavalry", moves the same as the standard Pawns and initially shares rows 2 and 7 therewith. (FIG. 1) Any Cavalry, like any Pawn, may move one square at a time straight ahead, (FIG. 13 arrows 26 and 27) with each piece having the option of moving either one or two squares straight ahead only on its first move of the game. They differ from the Pawn in that they are permitted to capture either one square forward or one square in either diagonal direction. They may capture diagonally, en passant, and straight ahead, and so may end up on one of the two diagonal squares or the square directly ahead. (FIG. 13, arrows 28) As with the Pawn they cannot jump nor move nor capture backwards. (FIG. 13)

Figure 14:
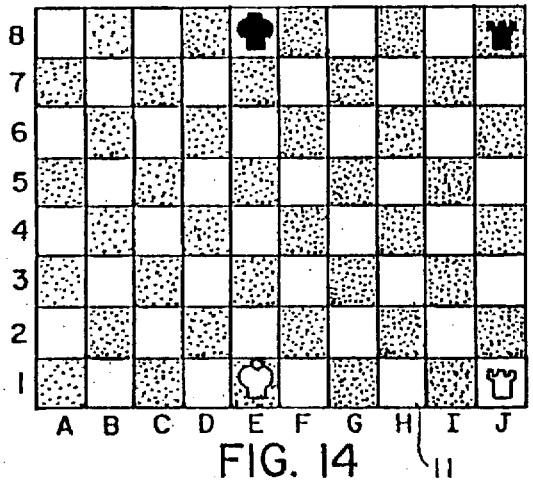
Figure 15:
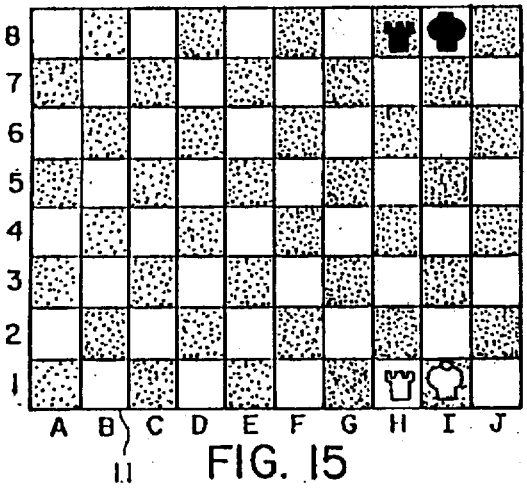
Figure 16:
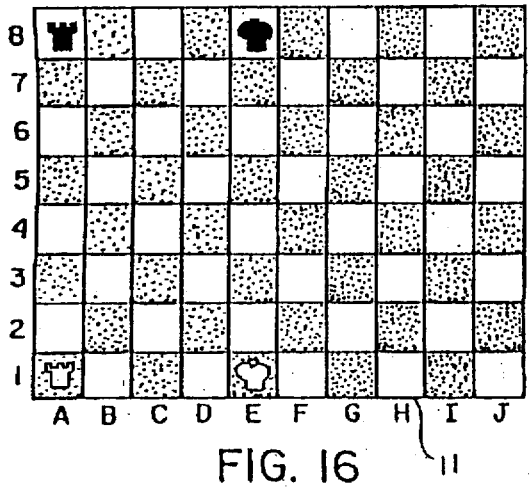
Figure 17:
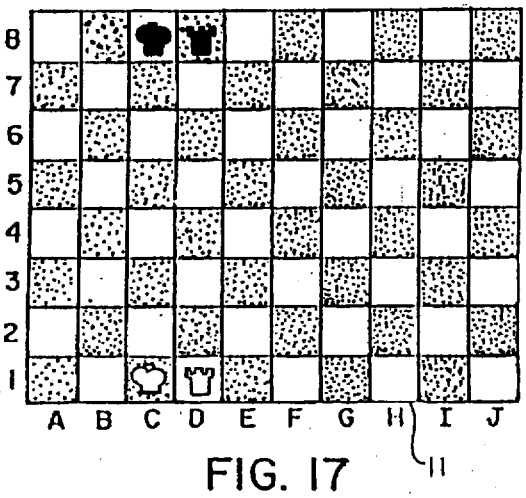

As in the standard chess game, each player in the advanced chess game 10 may make a special move, only once, to protect his or her King. This special move is a procedure known as "castling" with which the player can move two pieces, both his or her King and one or the other of his or her Rooks at once. The combined movements of King and Rook count as only one move. In the advanced chess game, the King may be moved four squares to the right towards the Rook, which is then placed next to the King in the direction of the King's original position. This is called "Queen Side" castling. (FIGS. 14 and 15) For "King Side" castling, the King is moved two squares to the left towards the Rook, which is then placed next to the King in the direction of the King's starting position. (FIGS. 16 and 17)

Castling is not possible if either the King or the intended Rook has moved before in the game, nor if the King is in check, nor if any pieces stand between the King and the Rook intended to be moved. The King cannot move within the attacking range of an enemy piece during castling, but if the enemy piece is moved or otherwise disappears, then castling is again possible. The King cannot pass over a square commanded by the enemy during castling. If this control disappears and all other conditions are met satisfactorily, castling is then again possible.

As previously stated, the Pawn moves in accordance with its mode of movement in the standard chess game. If a Pawn in row 2 in the advanced game 10 successfully reaches the opposing player's edge row, row 8 for example, it may be traded for any chosen pie Similarly standard chess game.

Similarly to the Pawn, the new Cavalry piece upon reaching the opposing player's edge row, may be traded for any active piece except the Queen.

Thus, both the Pawn and the Cavalry are very powerful pieces if they can be made to reach the opposing player's edge row. For example, a Queen previously lost may be replaced. Or the attacking player may add an additional Queen and enjoy the use of two.

The ending of the game by checkmate of a King has previously been described. The game may also end with a condition called "stalemate". The game is ended in a draw in this case, because the opposing King is blocked from moving at all but is not in check and so cannot be captured. This situation may occur because of the King's inability to displace his own men within the range of his movement, and because the King cannot move into a position of check.

Another situation ending the game is a three times repeated movement of a piece. Then, the opposing player may if he desires consider the game a draw.

As described above, the advanced chess game 10 is played for the most part in accordance with the standard rules of chess. The castling procedure remains in the advanced game 10 but is changed somewhat in execution to take advantage of the increased number of squares across the horizontal rows of the playing board. The changes in playing the advanced game 10, including those associated with the new Checker and Cavalry pieces, and the changed procedure for promotion of the Pawn, have been described above. The basic rules of the standard game of chess are well known to those who play it. Many books of rules and strategy are available for the standard game. "Chess for Young People", by Fred Reinfeld, published by Holt, Rinehart and Winston, New York City, is one example. Another is "Official Rules of Chess", published by the United States Chess Federation.

The inventive advanced chess game 10 may be changed somewhat from that described herein without departing from the spirit and scope of the invention. For example, if desired, game pieces with different appearances from those shown but which function the same in the game could be used. It is only necessary that the pieces be readily distinguisable from each other. This may be accomplished by adoption of characteristic shapes as described above, or by labeling, numbering or lettering, to name a few examples. As previously suggested, folding boards, sectional boards and the like may be used for the game board 11. The advanced chess game described herein might also be played utilizing a computer screen, without any change in the moving and capturing power of the pieces, a transient image upon the screen replacing the traditional permanently embodied playing board.

The inventive apparatus may be embodied in other specific forms, and the method in other specific steps, without departing from the spirit or essential characteristics thereof. The present apparatus and method are therefore to be considered illustrative and not restrictive, the scope of the invention being indicated by the appended claims rather than by the foregoing description and all changes which come within the meaning and range of equivalency of the claims are therefore to be embraced therein.

I claim:

1. A method of playing an advanced chess game for use by a player and an opposing player, wherein each player uses game pieces upon a shared game board, said method comprising the steps:

providing a game board having an upper surface upon which the advanced chess game is to be played, said upper surface comprising a plurality adjoining squares over which the game pieces are moved;

providing the game pieces comprising a set thereof to be used by a player and another set thereof having the same pieces to be used by the opposing player upon the game board, each set of pieces including a subset of said pieces each selected from a set of game pieces for a standard chess game, said sets further including two new separate game pieces for playing the advanced chess game, one of said new pieces being called a Checker and having movement on the game board defined by moving an unlimited number of squares vertically or horizontally away from a square first occupied thereby, in one of a forward motion, a rearward motion, a left motion and a right motion to an ending square of the same color as that of said first occupied square, said piece having the power to jump only pieces occupying any intervening. squares of different color from said first occupied square, said move ending upon the square of the first encountered opposing game piece, by capture and displacement thereof, or upon a previously encountered empty square of said same color; and the other of said new game pieces being called a Cavalry for playing on said game board having movement on the game board defined by moving, at the option of the moving player, an amount equal to either one or two squares directly forwardly on its first move of the advanced chess game and a single square directly forwardly on all subsequent moves, said new piece being further characterized by its ability to capture opposing pieces either directly forwardly or diagonally forwardly; and wherein said upper surface has eight parallel adjacent horizontal rows with ten squares having alternating contrasting colors upon which the pieces are moved, said squares being arranged together into a rectangular shape.

2. The method of claim 1, wherein:

each of the eight parallel and adjacent rows of the squares when viewed a single square at a time from a first end square to an opposite end square of said row defines a color pattern that alternates between a first color and a second color, and said color pattern defines an unchanging color pattern of one of the first color and one of the second color when viewed by moving diagonally between any two of said squares.

3. The method of claim 1, wherein:

The standard game pieces include a King, a Queen, two Rooks, two Knights, two Bishops and five pawns, and each of said standard game pieces operates in the advanced chess game in accordance with all rules governing play of said standard pieces in a standard chess game, except that the procedure of castling requires horizontal movement of the King either four squares in the right direction prior to placement of the Rook inside and adjacent to the King in its new position, or movement of said king two squares in the left direction prior to placement of the Rook inside and adjacent to said King in its new position.

4. The method of claim 3, wherein:

the sets of pieces of the player and opposing player each further include two of the new pieces called Checkers and five of the new pieces called Cavalries.

5. The method of claim 4, wherein:

when any Calvary of either player reaches any of the squares of the first row of the other player, said Calvary may be changed to any one of a Rook, a Knight, a Checker and a Bishop.

6. The method of claim 1, wherein:

the new game piece called a Checker has a circular base joining an upwardly extending cylindrical portion capped by an overhanging, disc-shaped portion; and the new game piece called a Cavalry has a cylindrical base portion joining with a cylindrical upwardly extending portion capped by a conical uppermost portion.

7. The method of claim 1, wherein:

the player initially places ten of his game pieces in a first row of squares at the near edge of the game board from left to right as Rook, Knight, Bishop, Checker, King, Queen, Checker, Bishop, Knight and Rook and the remaining ten of his game pieces in a second row adjacent said first row from left to right as Cavalry, Pawn, Cavalry, Pawn, Cavalry, Pawn, Cavalry, Pawn, Cavalry and Pawn; and the opposing player initially places his twenty game pieces in the two rows of squares at the opposite edge of the game board in a pattern providing a mirror image of the locations of the twenty game pieces of the player.

8. A method of playing an advanced chess game comprising the steps:

providing at least one computer with a display screen and associated software for displaying upon and removing from the screen images of a playing surface of an advanced chess game board and of a set and an opposing set of game pieces, wherein said playing surface image comprises a plurality of adjoining squares over which the game piece images are moved;

providing game piece images comprising a set thereof to be used by a player and another set thereof having the same pieces to be used by the opposing player upon the game board image, each set of images of pieces includes a subset of said piece images each selected to represent a set of game pieces for a standard chess game, said sets further including images representing two new separate game pieces for playing the advanced chess game, one of said new pieces being called a Checker and having movement on the game board image defined by moving an unlimited number of squares vertically or horizontally away from a square first occupied thereby, in one of a forward motion, a rearward motion, a left motion and a right motion to an ending square of the same color as that of said first occupied square, said piece having the power to jump only pieces occupying any intervening squares of different color from said first occupied square, said move ending upon the square of the first encountered opposing game piece, by capture and displacement thereof, or upon a previously encountered empty square of said same color; and the other of said new game piece images being called a Cavalry for playing on said game board having movement on the game board defined by moving, at the option of the moving player, an amount equal to either one or two squares directly forwardly on its first move of the advanced chess game and a single square directly forwardly on all subsequent moves, said new piece being further characterized by its ability to capture opposing pieces either directly forwardly or diagonally forwardly; and wherein said upper surface image has eight parallel adjacent horizontal rows with ten squares having alternating contrasting colors upon which the piece images are moved, said squares being arranged together into a rectangular shape.

9. The method of claim 8, wherein:

each of the eight parallel and adjacent rows of the squares when viewed a single square at a time from a first end square to an opposite end square of said row defines a color pattern that alternates between a first color and a second color, and said color pattern defines an unchanging color pattern of one of the first color and one of the second color when viewed by moving diagonally between any two of said squares.

10. The method of claim 8, wherein:

The standard game piece images include images of a King, a Queen, two Rooks, two Knights, two Bishops and five Pawns, and each of said standard game pieces operates in the advanced chess game in accordance with all rules governing play of said standard pieces in a standard chess game, except that the procedure of castling requires horizontal movement of the King either four squares in the right direction prior to placement of the Rook inside and adjacent to the King in its new position, or movement of said King two squares in the left direction prior to placement of the Rook inside and adjacent to said King in its new position.

11. The method of claim 10, wherein:

the sets of piece images of the player and opposing player further include images of two of the new pieces called Checkers and five of the new pieces called Cavalries.

12. The method of claim 11, wherein:

When any Calvary image of either player reaches any of the square images of the first row of the other player, said Calvary image may be changed to an image of any of the Rook, a Knight, a Checker and a Bishop.

13. The method of claim 8, wherein:

the new game piece image called a Checker has a circular base joining an upwardly extending cylindrical portion capped by an overhanging, disc-shaped portion; and the new game piece image called a Cavalry has a cylindrical base portion joining with a cylindrical upwardly extending portion capped by a conical uppermost portion.

14. The method of claim 8, wherein:

the player initially places ten of his game piece images in a first row of squares at the near edge of the game image from left to right as Rook, Knight, Bishop, Checker, King Queen, Checker, Bishop, Knight and Rook and the remaining ten of his game piece image in a second row adjacent said first row from left to right as Cavalry, Pawn, Cavalry, Pawn, Cavalry, Pawn, Cavalry, Pawn, Cavalry and Pawn; and the opposing player initially places his twenty game piece images in the two rows of squares at the opposite edge of the game board in a pattern providing a mirror image of the locations of the twenty game piece images of the player.

* * * * *